US012774503B2

(12) United States Patent
Valencian

(10) Patent No.: US 12,774,503 B2
(45) Date of Patent: Oct. 27, 2026

(54) METHOD FOR TREATING A SURFACE OF A METALLIC PART OF A TURBOMACHINE

(71) Applicant: SAFRAN AIRCRAFT ENGINES, Paris (FR)

(72) Inventor: Sonia Valencian, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 902 days.

(21) Appl. No.: 17/907,069

(22) PCT Filed: Mar. 25, 2021

(86) PCT No.: PCT/FR2021/050516
§ 371 (c)(1),
(2) Date: Sep. 22, 2022

(87) PCT Pub. No.: WO2021/191568
PCT Pub. Date: Sep. 30, 2021

(65) Prior Publication Data

US 2023/0203608 A1 Jun. 29, 2023

(30) Foreign Application Priority Data

Mar. 27, 2020 (FR) ..... 2003061

(51) Int. Cl.
*C21D 7/06* (2006.01)
*C23G 1/24* (2006.01)

(52) U.S. Cl.
CPC *C21D 7/06* (2013.01); *C23G 1/24* (2013.01)

(58) Field of Classification Search
CPC ..... C21D 7/06; C23G 1/24
See application file for complete search history.

(56) References Cited

U.S. PATENT DOCUMENTS

2007/0107807 A1* 5/2007 Vigneau ..... B23P 9/00 148/320
2019/0119523 A1* 4/2019 Tamada ..... B24B 1/005

FOREIGN PATENT DOCUMENTS

| | | | | |
|---|---|---|---|---|
| CN | 101870851 A | | 10/2010 | |
| EP | 3272913 A1 | * | 1/2018 | ..... C25F 7/00 |
| JP | 2012035400 A | * | 2/2012 | ..... C25F 7/00 |
| PL | 218858 B1 | | 2/2015 | |

OTHER PUBLICATIONS

English translation of Written Opinion mailed Aug. 17, 2021, issued in corresponding International Application No. PCT/FR2021/050516, filed Mar. 25, 2021, 5 pages.

(Continued)

*Primary Examiner* — Angela C Brown-Pettigrew
*Assistant Examiner* — Brittany Sharon Harris
(74) *Attorney, Agent, or Firm* — CHRISTENSEN O'CONNOR JOHNSON KINDNESS PLLC

(57) ABSTRACT

A method for treating a surface of a metallic part in particular of a turbomachine includes a step of shot-peening a surface of the metallic part using metallic beads and a step of cleaning the surface of the metallic part after the shot peening. The cleaning step includes applying a magnetic cleaning paste to the surface of the metallic part in such a way as to remove any residues of metallic beads.

6 Claims, 1 Drawing Sheet

(56) References Cited

OTHER PUBLICATIONS

International Preliminary Report on Patentability mailed Sep. 22, 2022, issued in corresponding International Application No. PCT/FR2021/050516, filed Mar. 25, 2021, 6 pages.
International Search Report mailed Aug. 17, 2021, issued in corresponding International Application No. PCT/FR2021/050516, filed Mar. 25, 2021, 6 pages.
Written Opinion mailed Aug. 17, 2021, issued in corresponding International Application No. PCT/FR2021/050516, filed Mar. 25, 2021, 5 pages.

* cited by examiner

METHOD FOR TREATING A SURFACE OF A METALLIC PART OF A TURBOMACHINE

FIELD OF THE DISCLOSURE

The present disclosure relates to the field of surface treatment of metallic parts, in particular for turbomachine. In particular, it is aimed at cleaning the surface of the part after a shot-peening.

BACKGROUND

The prior art comprises the documents US-A1-2019/119523, US-A1-2007/107807, and PL-B1-218858.

It is known to modify the surface of turbomachine parts to improve their mechanical performance and their service life. An example of surface treatment is the shot-peening in which steel, ceramic or glass beads are projected at very high velocity onto the surface of the part so as to induce superficial compressive stresses in the part or at least eliminate the tensile stresses that are beneficial to the fatigue strength of the part. The shot-peening is used in production but also in the repair of turbomachine parts.

When the shot-peening involves the use of steel beads on metallic parts, these can become embedded. The presence of these ferrous residues is unacceptable on metallic parts, in particular titanium, as they can cause a galvanic coupling with the titanium during the operation of the turbomachine (high stress and temperature). The surface of each part must be cleaned or decontaminated in order to avoid an oxidation. Typically, the cleaning uses a chemical bath based on nitric acid in which the part is immersed. The nitric acid allows to dissolve the ferrous residues and the steel beads. However, the use of chemical baths can result in a Health, Safety and Environment (HSE) risk for the operators who have to prepare the chemical bath and also handle the parts in the chemical bath. The use of the chemical bath can also be sensitive from a feasibility point of view as the large parts require adequate tanks. The use of a buffer for a manual and spot cleaning by an operator can also present an HSE risk as a chemical is also used.

Alternatively, the part can be cleaned by means of a tribofinishing step in which the metallic part is immersed in a tank containing an abrasive media with possibly a binder. The metallic part and the abrasive media are stirred up in the tank, which allows to act on the surface roughness of the part and removes ferrous residues and steel beads by friction. However, this equipment is not available in all workshops, the tank must be the size of the part and this step is expensive.

Another solution is to use a high-pressure cleaner such as Kärcher® which sends a water jet onto the surface of the part at a pressure of about hundred bar. The mechanical impact of the water jet allows to remove the residues on the surface of the part. However, not all workshops are equipped with a pressure cleaner and this is also an expensive item of equipment.

SUMMARY

The objective of the present disclosure is to provide a simple and inexpensive solution allowing to effectively clean the surface of the part or a precise and small area of a part, without harming the environment and the health of the operators.

This is achieved in accordance with the disclosure by means of a method for treating the surface of a metallic part, in particular for turbomachine, the method comprising a step of shot-peening a surface of the metallic part using metallic beads and a step of cleaning the surface of the metallic part after the shot-peening, the cleaning comprising the application of a magnetic cleaning paste, comprising at least one polymer and a magnetic powder, to the surface of the metallic part so as to remove any residues of the metallic beads.

Thus, this solution allows to achieve the above-mentioned objective. In particular, this magnetic cleaning paste allows the removal of all metallic residues from metal beads by trapping them without using products that pose a risk to the operators and the environment. The cleaning paste allows to easily implement to all types of surfaces and can be used locally. Indeed, the cleaning paste allows to decontaminate a precise and small area of a part, which is relevant when the shot-peening only concerns a small area of the part (rework of a surface anomaly that requires regrinding for example). Furthermore, as far as the environment is concerned, such a paste can be treated as waste easily instead of tanks containing e.g. citric acid.

The method also comprises one or more of the following steps and/or characteristics, taken alone or in combination:

- the metallic part is made of titanium or a titanium alloy.
- the material of the metallic beads comprises steel.
- the method comprises a degreasing step subsequent to the cleaning step.

The disclosure further relates to a paste for cleaning a metallic part, in particular for turbomachine, comprising at least one polymer and a magnetic powder.

The paste also comprises one or more of the following characteristics, taken alone or in combination:

- the polymer is comprised in the group polyurethane, polyester-polyurethanes, polyether-polyurethane, polyester, polyamide, epoxyester resin, polyesteramides and/or alkyds, polysiloxanes and mixtures thereof.
- the magnetic powder comprises magnetite or iron filings.
- the magnetic powder comprises an amount by weight between 40 and 80% of the total weight of the paste.

DESCRIPTION OF THE DRAWINGS

The disclosure will be better understood, and other purposes, details, characteristics and advantages thereof will become clearer on reading the following detailed explanatory description of embodiments of the disclosure given by way of purely illustrative and non-limiting examples, with reference to the attached schematic drawings in which.

DETAILED DESCRIPTION

Figure 1:
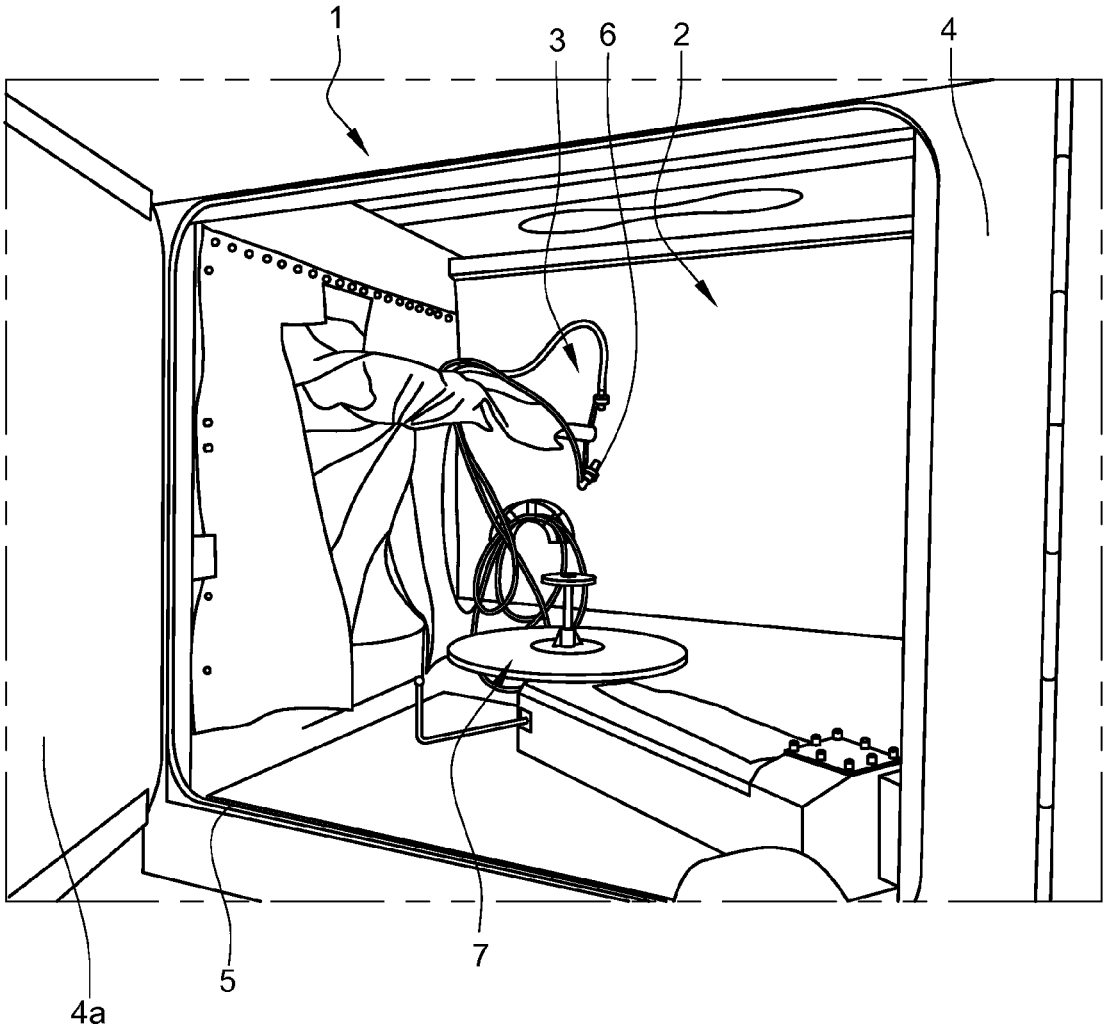
FIG. 1 is a schematic axial cross-sectional view of a shot-peening installation to which the disclosure applies.

FIG. 1 shows an installation 1 for the surface treatment of a metallic part, in particular a turbomachine. Of course, the disclosure is not limited to the turbomachine parts.

The installation 1 for the surface treatment is a shot-peening installation. More specifically, the installation comprises an enclosure 2 and a bead projecting device 3. The enclosure comprises lateral walls 4, one of which comprises an opening 5 allowing the installation of the part in the enclosure 2. The projecting device 3 is installed inside the enclosure 2 and comprises nozzles 6 for spraying beads as projectiles onto the surface of the part to be treated at high speed. A support 7 intended to hold a metallic part 8 is arranged within the enclosure. In other words, the walls of the enclosure surround the metallic part. The support 7 can be movable in rotation to drive the metallic part in rotation. A door 4*a* allows to close off the opening 5 to prevent beads from being sprayed out of the enclosure during the shot-peening operation.

Alternatively, the beads are sprayed onto the surface 10 of the part using ultrasound. In this case, the bead projecting device comprises one or more sonotrodes (not shown) each comprising a vibrating surface which is intended to move the beads towards the surface of the part.

The beads are metallic. These are advantageously, but not necessarily, made of steel. The beads have a diameter of between 0.5 and 2 mm and a hardness of between 8 and 10 Mohs.

The metallic part 8 to be treated can be a turbine vane, a movable wheel intended to carry vanes or another member of the turbomachine. The material of the metallic part is comprised in the group comprising titanium or titanium alloy, steel, aluminium, and nickel-based super-alloys. Advantageously, but not restrictively, the metallic part is made of titanium or titanium alloy.

In a method for treating the surface of a metallic part, in particular for a turbomachine, it comprises a step of shot-peening the surface of the metallic part to be treated. The shot-peening step is carried out by means of a shot-peening installation as described above.

The method then comprises a step of cleaning the surface of the metallic part to remove any embedded beads 9 or metallic residue deposits from the surface of the metallic part. In the case of steel beads, the deposit comprises ferrous residues.

Figure 2:
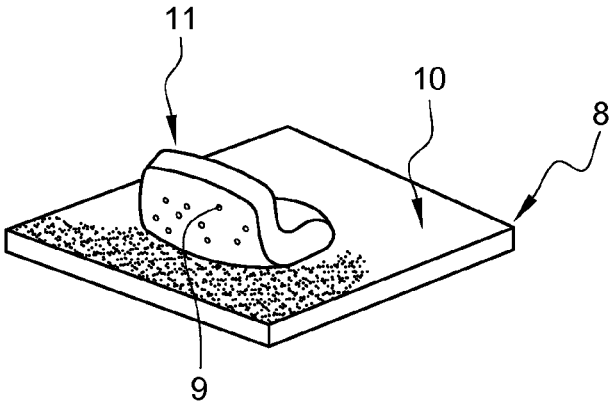
FIG. 2 shows a schematic perspective view of the application of a cleaning paste to the surface of a segment of a "shot-peened" metallic part to be treated according to the disclosure.

With reference to FIG. 2, the cleaning step comprises the application of a magnetic cleaning paste 11 to the surface 10 of the part. As the cleaning paste 11 is magnetic, it will be able to "attract" the beads 9 or residues of the material of the beads more easily.

In the present disclosure, the term "paste" is taken to mean a composition which is soft, i.e. which has a viscosity between a solid and a liquid and which is easily malleable.

The cleaning paste 11 is flexible or soft so that it can access all the hard-to-reach areas of the surface of the metallic part. Typically, the cleaning paste 11 is malleable by hand at room temperature.

In the present application, the cleaning paste 11 comprises at least one polymer and a magnetic powder.

The polymer allows on one hand to hold the magnetic powder together in the paste and, on the other hand, to adhere to the part to loosen the beads 9 or residues of the material of the beads.

The polymer is selected from the group comprising polyurethane, polyester-polyurethanes, polyether-polyurethane, polyester, polyamide, epoxyester resin, polyesteramides and/or alkyds, polysiloxanes and mixtures thereof. Advantageously, the polymer is silicone (polysiloxane).

The magnetic powder comprises an amount by weight between 40% and 80% of the total weight of the paste 11 comprising the polymer.

The magnetic material is selected from the group comprising magnetite or iron filings. The iron has a high magnetic susceptibility compared to the titanium. The magnetite allows the iron of the steel beads to be easily attracted to the part made of titanium. The magnetic susceptibility is the ability of a part to become magnetised under the action of a magnetic excitation.

In particular, the material of the beads has a higher magnetic susceptibility than that of the material of the metallic part.

The magnetic powder comprises particles with a particle size of between 200 μm and 800 μm.

In the cleaning step, the cleaning paste 11 is "rolled" onto the surface 10 of the part 8 so that the magnetic particles trap the residues of the metallic beads in the cleaning paste. We understand that there is no friction which allows the physical integrity (e.g. scratches) of the part to be maintained after the paste has passed through. At each passage, the operator kneads the paste 11 and the residues to obtain a homogeneous mixture and to apply this mixture again on the surface of the part to be treated.

Finally, the method comprises a degreasing step after the cleaning step. The degreasing step allows to remove all greasy residues and metallic deposits from the surface of the part. The greasy residues are related to the handling of the part and the nature of the cleaning paste.

The degreasing step is carried out using a cleaning or degreasing bath that is compatible with the material of the metallic part. The cleaning bath consists of immersing the part for a specific time in alkaline solutions and under defined temperature and concentration conditions.

Alternatively, the surface of the part is sprinkled with the cleaning bath under the same time and temperature conditions.

The cleaned (decontaminated) and degreased surface of the metallic part is free of all residues and is ready to be put into service or put back into service under the intended conditions of use. The treated part will not undergo galvanic cutting during its operation.

The invention claimed is:

1. A method for treating a surface of a metallic part, the method comprising a step of shot-peening a surface of the metallic part using metallic beads and a step of cleaning the surface of the metallic part after the shot-peening, wherein the cleaning step comprises rolling a magnetic cleaning paste, without friction, which allows the physical integrity of the part to be maintained, which comprises at least one polymer and a magnetic powder onto the surface of the metallic part so as to remove any residues of the metallic beads by attracting and trapping the residues, wherein the polymer allows on one hand to hold the magnetic powder together in the magnetic cleaning paste and, on the other hand, to adhere to the metallic part to loosen the residues of the metallic beads.

2. The method according to claim 1, wherein the metallic part is made of titanium or a titanium alloy.

3. The method according to claim 1, wherein the material of the metallic beads comprises steel.

4. The method according to claim 1, further comprising a degreasing step subsequent to the cleaning step.

5. The method according to claim 1, wherein the metallic part is a turbomachine part.

6. The method according to claim 1, wherein the magnetic powder comprises particles with a particle size of between 200 μm and 800 μm.

* * * * *